US006939163B2

(12) United States Patent
Fujita

(10) Patent No.: US 6,939,163 B2
(45) Date of Patent: Sep. 6, 2005

(54) CONNECTOR

(76) Inventor: Shinya Fujita, c/o Sumitomo Wiring Systems, Ltd. 1-14, Nishisuehiro-cho, Yokkaichi-City, Mie (JP), 510-8503

( * ) Notice: Subject to any disclaimer, the term of this patent is extended or adjusted under 35 U.S.C. 154(b) by 0 days.

(21) Appl. No.: 10/858,018

(22) Filed: Jun. 1, 2004

(65) Prior Publication Data

US 2004/0242084 A1 Dec. 2, 2004

(30) Foreign Application Priority Data

May 29, 2003 (JP) ..... 2003-152725

(51) Int. Cl.[7] ..... H01R 13/64
(52) U.S. Cl. ..... 439/381; 439/374
(58) Field of Search ..... 439/381, 686, 439/695, 701, 374, 680

(56) References Cited

U.S. PATENT DOCUMENTS 5,533,909 A * 7/1996 Endo et al. ..... 439/381
5,556,288 A * 9/1996 Ishii et al. ..... 439/135
5,599,200 A * 2/1997 Yagi et al. ..... 439/381
6,447,310 B1 * 9/2002 Brown ..... 439/108

FOREIGN PATENT DOCUMENTS

JP 9-219238 8/1997

* cited by examiner

*Primary Examiner*—Gary Paumen
(74) *Attorney, Agent, or Firm*—Gerald E. Hespos; Anthony J. Casella

(57) ABSTRACT

A female connector (F) has female terminal fittings (10), female auxiliary housings (20) for accommodating the female terminal fittings (10), and a female frame for accommodating the female auxiliary housings (20). A male connector (M) has male terminal fittings (40) with tabs (41), male auxiliary housings (50) for accommodating the male terminal fittings (40), and a male frame (60) with a receptacle (61) for accommodating the male auxiliary housings (50) and into which the female connector (F) is fittable. A moving plate (70) is movable backward in the receptacle and has positioning holes (73) into which the tabs (41) are introduced. The moving plate (70) has positioning projections (80), and the female auxiliary housings (20) has positioning recesses (81) engageable with the positioning projections (80). Thus, the moving plate (70) and the female auxiliary housings (20) can be positioned with respect to each other.

11 Claims, 5 Drawing Sheets

CP

CONNECTOR

BACKGROUND OF THE INVENTION

1. Field of the Invention

The present invention relates to a connector.

2. Description of the Related Art

Japanese Unexamined Patent Publication No. H09-219238 shows a divided connector assembled by mounting a plurality of auxiliary housings into frames. A female divided connector has a plurality of female auxiliary housings with female terminal fittings inserted therein. The female auxiliary housings then are mounted into a female frame. The female divided connector then can be connected with a male divided connector assembled in a similar manner. The male frame has a receptacle into which the female divided connector is fittable, and tabs of male terminal fittings project in this receptacle.

The tabs project a long distance in the receptacle in the above male divided connector. Thus, there is a possibility of at least slight displacements of the leading ends of the tabs. A moving plate can be mounted in the receptacle to prevent displacement of the tabs. The moving plate has positioning holes through which the tabs are inserted, and is pushed backward in the receptacle by the female divided connector at the time of connecting the two connectors.

The female auxiliary housings and the female frame shake relative to each other in the female divided connector. Thus, the female terminal fittings are displaced with respect to the tabs even if the tabs are positioned by the moving plate. Thus, the alignment of the female terminal fittings and that of the male terminal fittings do not agree any longer and the tabs may not be smoothly insertable into the female terminal fittings.

The present invention was developed in view of the above problem and an object thereof is to smoothly connect male and female terminal fittings.

SUMMARY OF THE INVENTION

The invention relates to a connector having a male connector and a female connector connectable with each other along a connecting direction. The female connector comprises a female housing for accommodating at least one female terminal fitting. The male connector comprises a housing with a receptacle into which the female connector is fittable. The male connector also has at least one male terminal fitting with a tab that projects into the receptacle. A moving plate is formed with positioning holes for receiving and positioning the respective tabs and is mountable in the receptacle for movement along the connecting direction. The moving plate and/or the female housing comprise positioning means in the form of projections and recesses that engage to position the moving plate and the female housing with respect to each other.

The female connector preferably comprises auxiliary housings for accommodating the female terminal fittings, and a frame for accommodating the auxiliary housings. The positioning means of the moving plate and the auxiliary housings engage to position the auxiliary housings with respect to the moving plate when the female connector is fit into the receptacle. Accordingly, the auxiliary housings and the moving plate, i.e. the female terminal fittings and the respective tabs, are positioned by the positioning means even if the auxiliary housings and the frame shake relative to each other in the female connector. Therefore, the male and female terminal fittings are connected smoothly as the two connectors are connected.

The moving plate preferably is held between the housing and the female connector at the time of connecting the two connectors.

The positioning means preferably comprise positioning projections on the moving plate and positioning recesses in the female housing, preferably in the auxiliary housings, for engaging the positioning projections. The positioning projections on the moving plate can be protected by the receptacle before the connection of the two connectors.

The positioning recesses preferably are formed by cutting off preferably corners at the lateral edges of front ends of the female auxiliary housings over substantially the entire widths of the female auxiliary housings.

The positioning projections preferably have a triangular, pointed or converging cross section.

The moving plate preferably is at an initial position where the leading ends of the respective tabs are in the positioning holes and project slightly from the front surface of the base plate before the connectors are connected.

The positioning projections preferably project from the front surface of the moving plate more than a projecting distance of the tabs from the front surface of the base plate when the moving plate is at the initial position.

A spacing between the tips of the positioning projections laterally from the positioning holes preferably is substantially equal to the height of the female housing, preferably of the female auxiliary housings.

The width of the positioning projections preferably is less than the outer width of the female housing, preferably of the female auxiliary housings.

The moving plate preferably comprises a base plate and one or more side plates at an edge of the base plate. Movement of the moving plate along the connecting direction is guided by the sliding contact of the one or more side plates with the inner peripheral surface of the receptacle.

These and other features of the invention will become more apparent upon reading the following detailed description and accompanying drawings. It should be understood that even though embodiments are separately described, single features thereof may be combined to additional embodiments.

DETAILED DESCRIPTION OF THE PREFERRED EMBODIMENTS

Divided male and female connectors according to the invention are identified by the letters M and F in FIGS. 1 to 5 are connectable with each other. Sides of two connectors F, M to be connected are referred to as the fronts.

Figure 1:
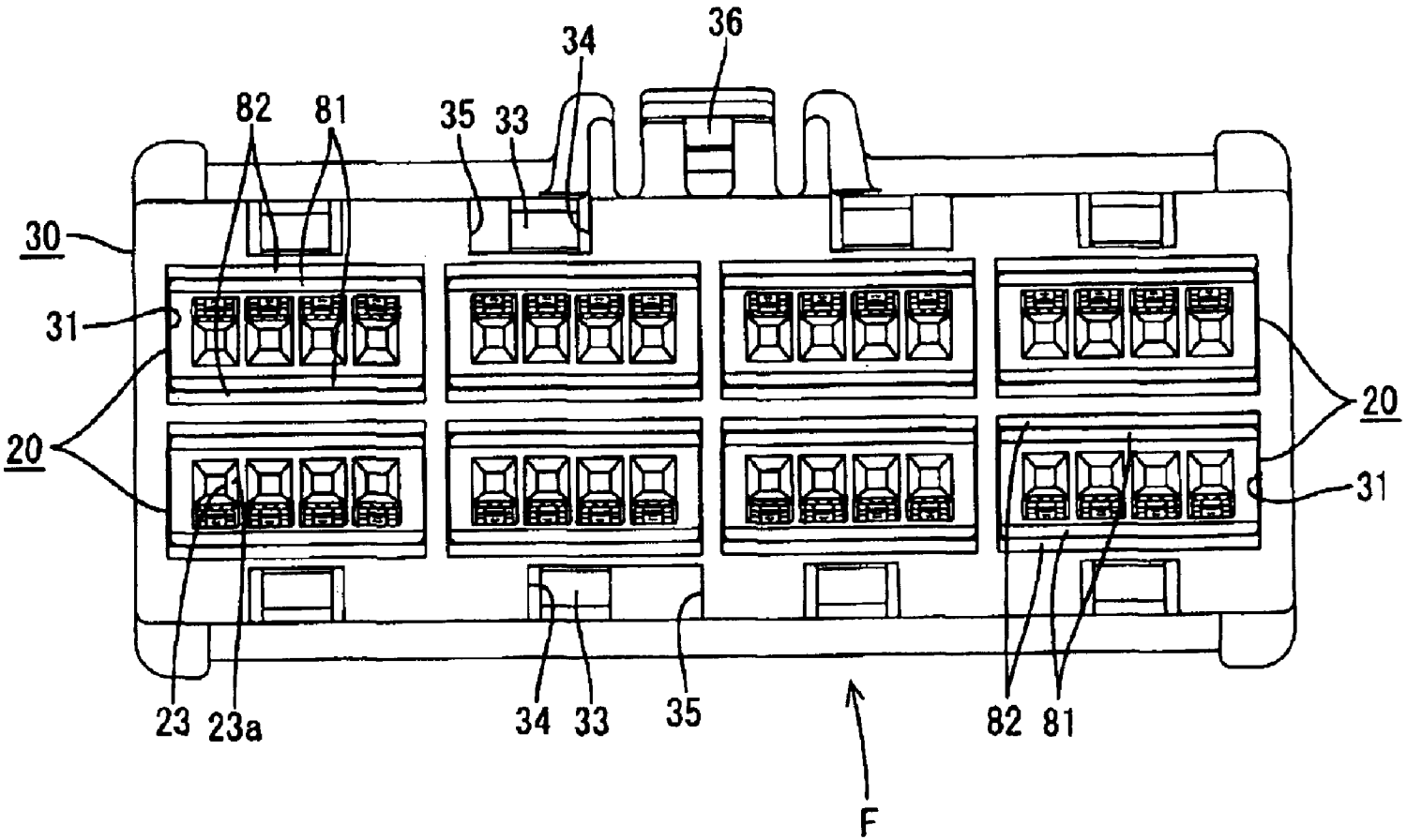
FIG. 1 is a front view of a female connector according to one embodiment of the invention.
Figure 3:
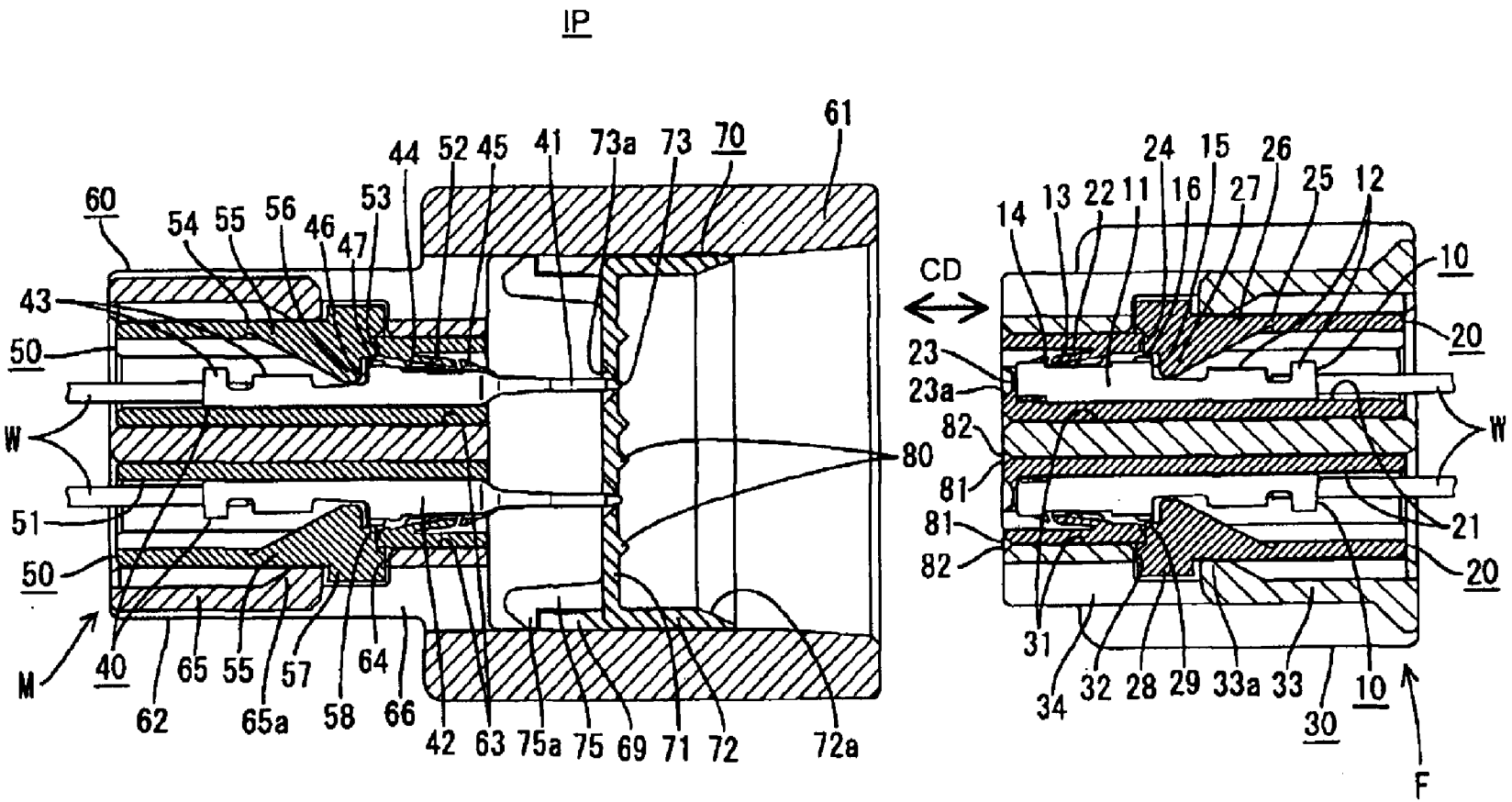
FIG. 3 is a side view in section showing a state before the two connectors are connected.

The female connector F has female terminal fittings 10 connected with ends of wires W. The female connector F also has female auxiliary housings 20 for accommodating the female terminal fittings 10, and a female frame 30 for accommodating the female auxiliary housings 20, as shown in FIGS. 1 and 3.

Each female terminal fitting 10 is press-formed of a conductive metallic plate into a specified shape and has a main portion 11 and a barrel 12 coupled one after the other. The main portion 11 is a substantially rectangular tube. A recess 13 is formed in the upper surface of the main portion 11, and an edge of the recess 13 is embossed to project out for defining a locking projection 14. A step is formed at the rear end of the main portion 11 and defines a locking step 15. A protrusion 16 is formed at the locking step 15 by embossing or by cutting and folding and projects out to substantially the same height as the locking projection 14. A resilient contact piece (not shown) is provided in the main portion 11 for resilient contact with a tab 41 of a male terminal fitting 40. The barrel 12 includes two front crimping pieces to be crimped, bent or folded into connection with a core of the wire W and two rear crimping pieces to be crimped, bent or folded into connection with an insulation coating of the wire W.

Each female auxiliary housing 20 is made e.g. of a synthetic resin, and is a substantially long narrow block along forward and backward directions. Cavities 21 extend through each female auxiliary housing 20 along forward and backward directions and the female terminal fittings 10 are insertable into the cavities 21 from behind. Resiliently deformable locks 22 are cantilevered at the inner surfaces of front parts of the cavities 21. Each lock 22 is engageable with the front edge of the recess 13 and with the locking projection 14 of the female terminal fitting 10 that has been inserted to a proper depth into the cavity 21. The front wall of each cavity 21 has a tab insertion hole 23 for permitting entry of the tab 41 into the cavity 21 from the front, and a slanted guiding surface 23*a* is formed around the front edge of the tab insertion hole 23 for guiding the tab each female auxiliary housing 20 behind the locks 22, and the retainer 26 is coupled to the rear edge of the opening 24 via a hinge 25.

The retainer 26 is rotatable about the hinge 25 to open and close the opening 24. A terminal locking portion 27 is provided on the inner surface of the retainer 26 and cooperates with the locks 22 to hold the female terminal fittings 10 so as not to come out backward. More particularly, the terminal locking portion 27 projects into the cavities 21 for engaging the locking steps 15 and the protrusions 16 of the female terminal fittings 10. A frame locking portion 28 is provided on the outer surface of the retainer 26 and projects further out from the outer surface of the rear part of the female auxiliary housing 20 for engaging the female frame 30. A retainer holding portion 29 is provided before the terminal locking portion 27 of the retainer 26 for holding the retainer 26 at a closing position by engaging the front inner edge of the opening 24.

The female frame 30 is made e.g. of a synthetic resin and is substantially lattice-shaped. Four accommodating chambers 31 are arranged substantially along the widthwise direction at upper and lower stages, and the female auxiliary housings 20 are insertable into the accommodating chambers 31 from behind. An opening 32 is formed in an outer wall of each accommodating chamber 31 at a side corresponding to the retainer 26, and a resilient piece 33 is cantilevered at the rear edge of the opening 32. Each resilient piece 33 is resiliently deformable along a height direction HD in a direction intersecting an inserting direction of the auxiliary housing 20 into the female frame 30. A holding portion 33*a* is provided on the inner surface of the leading end of the resilient piece 33 and projects in for engaging the rear surface of the frame locking portion 28 of the auxiliary housing 20. The front surface of the frame locking portion 28 of the female auxiliary housing 20 that has reached a proper depth contacts the front edge of the opening 32 so that the female auxiliary housing 20 does not move any further forward. Forwardly open notches 34 are formed in an outer wall of the female frame 30 where the resilient pieces 33 are provided. The notches 34 are formed by removing a mold for forming the resilient piece 33. Grooves 35 for receiving respective ribs 68 of the male connector M during connection of the two connectors F, M communicate with the second notches 34 laterally from the left in FIG. 1. Further, a lock arm 36 projects in substantially the widthwise middle of the upper surface of the female frame 30.

Figure 2:
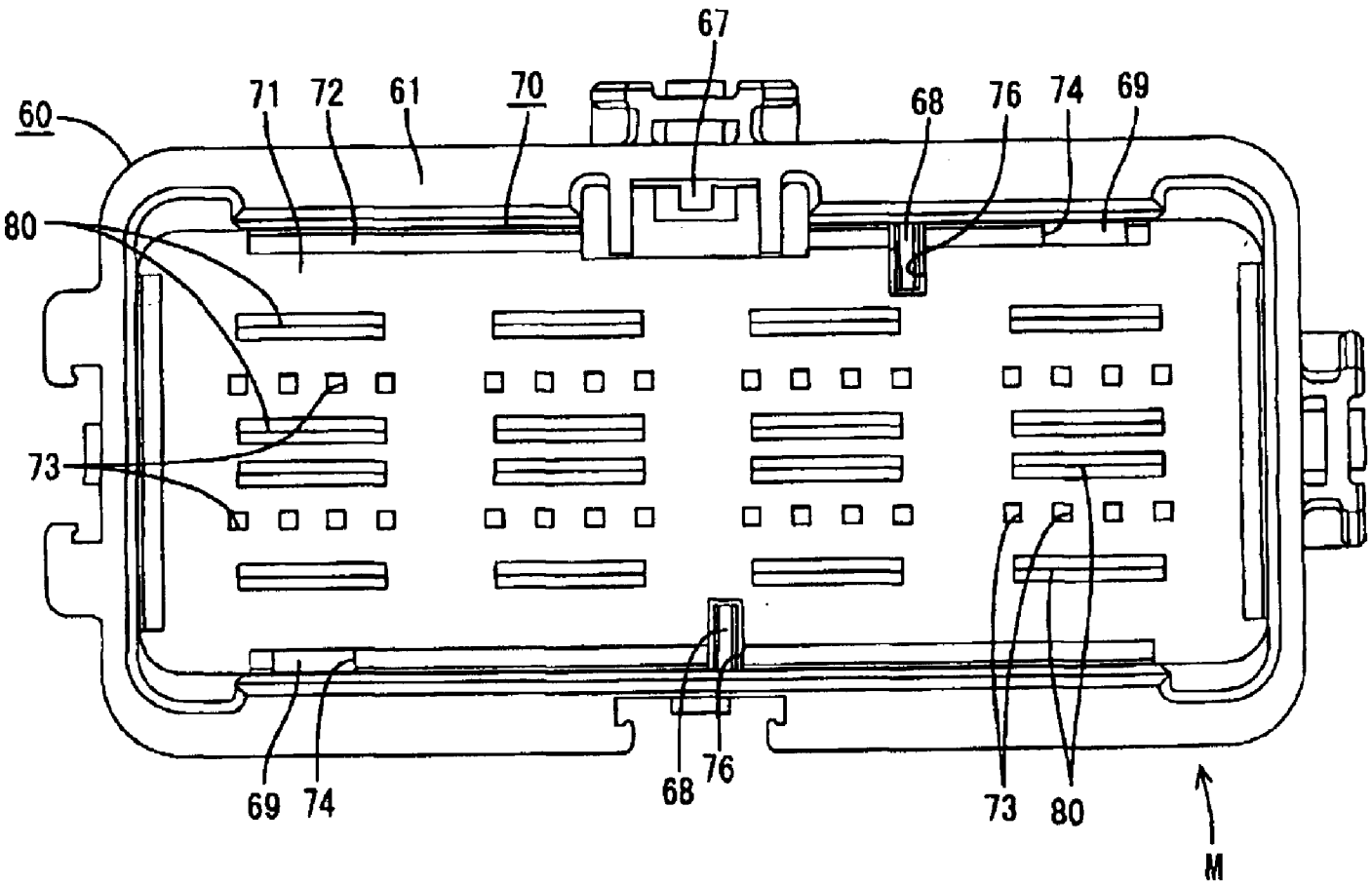
FIG. 2 is a front view of a male connector.

As shown in FIGS. 2 and 3, the male connector M is comprised of male terminal fittings 40 to be connected with ends of wires W. The male connector M also has eight male auxiliary housings 50 for accommodating the male terminal fittings 40, a male frame 60 for accommodating the male auxiliary housings 50 and a moving plate 70 mountable into or to the male frame 60.

Each male terminal fitting 40 is press-formed of a conductive metallic plate into a specified shape and includes a tab 41, a substantially box-shaped main portion 42 and a barrel 43 in this order from front side. The tab 41 extends from the front edge of the main portion 42 and is formed by folding a plate piece that is long in forward and backward directions to bring folded sections into close contact. The main portion 42 preferably is provided with a recess 44, a locking projection 45, a locking step 46 and/or a protrusion 47. However, no detailed description is given concerning the shapes of functions of these parts since they are substantially the same as the female terminal fittings 10 already described. The barrel 43 is configured to be crimped, bent or folded into connection with the end of the wire W.

Each male auxiliary housing 50 is made e.g. of a synthetic resin and is a block that is long and narrow along forward and backward directions. Four cavities 51 are arranged substantially side by side along a width direction at positions substantially corresponding to those of the female connector F. The tab 41 projects forward from the male auxiliary housing 50 when the male terminal fitting 40 is inserted to a proper depth into the cavity 51. The male auxiliary housings 50 have locks 52, openings 53, retainers 55 (including hinges 54), terminal locking portions 56, frame locking portions 57 and retainer holding portions 58 substantially the same as those of the female auxiliary housings 20 already described. Thus, no further description is provided.

The male frame 60 is made e.g. of a synthetic resin and has a receptacle 61 and a frame main body 62 coupled one after the other. The receptacle 61 is a substantially lattice-shaped rectangular tube. The frame main body 62 has accommodating chambers 63 into which the male auxiliary housings 50 are insertable from behind. Four accommodating chambers 63 are arranged along the width direction at upper and lower stages. The male frame 60 has openings 64, resilient pieces 65, holding portions 65*a* and notches 66 substantially same as those of the female frame 30. Thus, no further description is provided.

The tabs 41 of the male terminal fittings 40 project from the front end surface of the frame main body 62 and into the receptacle 61 with the male auxiliary housings 50 accommodated in the male frame 60. The moving plate 70 is mountable into the receptacle 61 from the front and the female connector F is fittable therein. A lock 67 is provided substantially in the widthwise middle of the upper surface of the receptacle 61 for engaging the lock arm 36 of the female connector F and holding the two connectors F, M connected. Ribs 68 project on the inner surfaces of the receptacle 61 to the right of the lock 67 and from the opposite side below the lock 67 in FIG. 2. The ribs 68 can enter rib escaping grooves 76 of the moving plate 70 and the grooves 35 of the female connector F. Accordingly, the ribs 68 and the rib escaping grooves 76 are in positions that are not point symmetric with respect to an imaginary longitudinally extending center line. An attempt could be made to mount the moving plate 70 or connect the female connector F while the moving plate 70 or the female connector F is turned around the imaginary center line (e.g. upside down) from it proper posture. However, the ribs 68 will contact an end of the moving plate 70 or the female connector F to prevent the moving plate 70 or the female connector F from being mounted or connected. Holding projections 69 on the inner surfaces of the receptacle 61 project in at a positions to the right of the upper rib 68 in FIG. 2 and to the left of the lower rib 68 in FIG. 2 for holding the moving plate 70.

The moving plate 70 is made e.g. of a synthetic resin and has a base plate 71 and side plates 72. The base plate 71 faces the back end surface of the receptacle 61 when the moving plate 70 is mounted in the receptacle 61. The side plates 72 project forward toward the female connector F from the peripheral edge of the base plate 71 to face the inner peripheral surface of the receptacle 61. The moving plate 70 is a substantially bottomed rectangular tube. Positioning holes 73 are formed in the base plate 71 at positions corresponding to the tabs 41. Thus, the tabs 41 of the male terminal fittings 40 that project into the receptacle 61 are insertable through the positioning holes 73. Four positioning holes 73 are formed substantially side-by-side along the width direction for each male auxiliary housing 50, i.e. a total of thirty-two positioning holes 73. A converging surface 73*a* is formed around the rear edge of each positioning hole 73 for guiding an insertion of the tabs 41. The side plates 72 are at positions excluding four corners of the base plate 71 when viewed from the front and a portion corresponding to the lock 67, and the female connector F is fittable inside the side plates 72. A slanted or rounded converging guiding surface 72*a* for guiding an insertion of the female connector F is formed at the inner front edge of each side plate 72.

The leading ends of the tabs 41 project through the positioning holes 73 and slightly beyond the front surface of the base plate 71 when the moving plate 70 is at an initial position in the receptacle 61 where the base plate 71 is away from the back end surface of the receptacle 61 by a distance slightly shorter than the length of the tabs 41 (see FIG. 3). Thus, the leading ends of the tabs 41 are held constantly at specified positions even if the male terminal fittings 40 shake relative to the male auxiliary housings 50 along height and width directions (directions intersecting a connecting direction CD) or the male auxiliary housings 50 shake relative to the male frame 60 along height and/or width directions. The moving plate 70 is moved back substantially along the connecting direction CD as the base plate 71 is pushed by the female connector F from this initial position. In this process, a backward movement can be guided by the sliding contact of the side plates 72 with the inner peripheral surface of the receptacle 61. The moving plate 70 reaches a connection position CP when the female connector F is connected to a proper depth (see FIG. 5). The rear surface of the base plate 71 substantially contacts the back end surface of the receptacle 61 when the moving plate 70 is in the connection position CP. In this state, the base plate 71 is held between the front surface of the frame main body 62 and the front surface of the female connector F, the side plates 72 are held between the inner peripheral surface of the receptacle 61 and the outer peripheral surface of the female connector F, and base ends of the tabs 41 are inserted deeper into the respective positioning holes 73.

Two escaping grooves 74 for receiving the holding projections 69 are formed at positions on the moving plate 70 corresponding to the holding projections 69 of the receptacle 61 and penetrate the moving plate 70 along forward and backward directions. Two resilient holding pieces 75 project back from the rear surface of the base plate 71 and are resiliently deformable along a height direction HD that is substantially normal to the connecting direction CD. Hooks 75*a* project from the outer surfaces of the leading ends of the resilient holding pieces 75. The hooks 75*a* are engageable with the rear surfaces of the holding projections 69 when the moving plate 70 is at the initial position IP. Thus, the moving plate 70 can be held so as not to come out forward from the initial position IP. Two rib-escaping grooves 76 are provided at positions of the moving plate 70 corresponding to the ribs 68 in the receptacle 61 for receiving the respective ribs 68. The moving plate 70 can be held temporarily at the initial position IP by an unillustrated temporary holding means unless being pushed backward with an operation force of a specified intensity or higher.

The moving plate 70 and the female auxiliary housings 20 are provided with positioning means for positioning the female auxiliary housings 20 with respect to the moving plate 70. The positioning means include positioning projections 80 on the moving plate 70 and positioning recesses 81 formed in the female auxiliary housings 20 for engaging the positioning projections 80. More specifically, as shown in FIGS. 2 and 3, two positioning projections 80 are formed on the front surface of the moving plate 70 to project at positions adjacent to (above and/or below) each group of four substantially side-by-side positioning holes 73, i.e. a total of sixteen positioning projections 80 are provided in this example. Each positioning projection 80 has a converging cross section with slanted upper and lower surfaces that have substantially the same angle of inclination. Each positioning projection projects by a distance so that the front tip is slightly more forward along the connecting direction CD than the leading end of the tab 41 at the initial position IP (see FIG. 3). A space between the tips of the positioning projections 80 above and below the positioning holes 73 is substantially equal to the height of the female auxiliary housings 20 at their front ends. The width of the positioning projections 80 is less than the outer width of the female auxiliary housings 20 (see FIG. 2).

As shown in FIGS. 1 and 3, the positioning recesses 81 are formed by cutting off corners at the upper and bottom edges of the front ends of the female auxiliary housings 20. The positioning recesses 81 are formed over substantially the entire widths of the female auxiliary housings 20 and can receive the inner halves of the positioning projections 80. Escaping recesses 82 for receiving the outer halves of the positioning projections 80 are formed at portions of the female frame 30 adjacent the positioning recesses 81, i.e. the upper and bottom edges of the front ends of the accommodating chambers 31. Surfaces of the positioning recesses 81 and the escaping recesses 82 facing each other are formed into slanted surface of substantially equal inclinations that conform to the slanted surfaces of the positioning projections 80. Accordingly, the positioning projections 80 are engaged with both the positioning recesses 81 and the escaping recesses 82 at the time of connecting the two connectors F, M. At this time, the female auxiliary housings 20 are positioned along height direction HD and substantially normal to the connecting direction CD with respect to the moving plate 70 by having the front ends thereof held between the positioning projections 80 located above and below the positioning holes 73 (see FIG. 4).

The female connector F is assembled by inserting the female terminal fittings 10 into the respective cavities 21 of the female auxiliary housings 20 and then closing the retainers 26. The female auxiliary housings 20 then are accommodated into the accommodating chambers 31 of the female frame 30. On the other hand, the male connector M is assembled by inserting the male terminal fittings 40 into the respective cavities 51 of the male auxiliary housings 50 and then closing the retainers 55. The male auxiliary housings 50 then are accommodated into the accommodating chambers 63 of the male frame 60. The moving plate 70 also is mounted at the initial position IP in the receptacle 61. Thus, the leading ends of the tabs 41 are introduced into the corresponding positioning holes 73 and are positioned with respect to directions intersecting the connecting direction CD.

Figure 4:
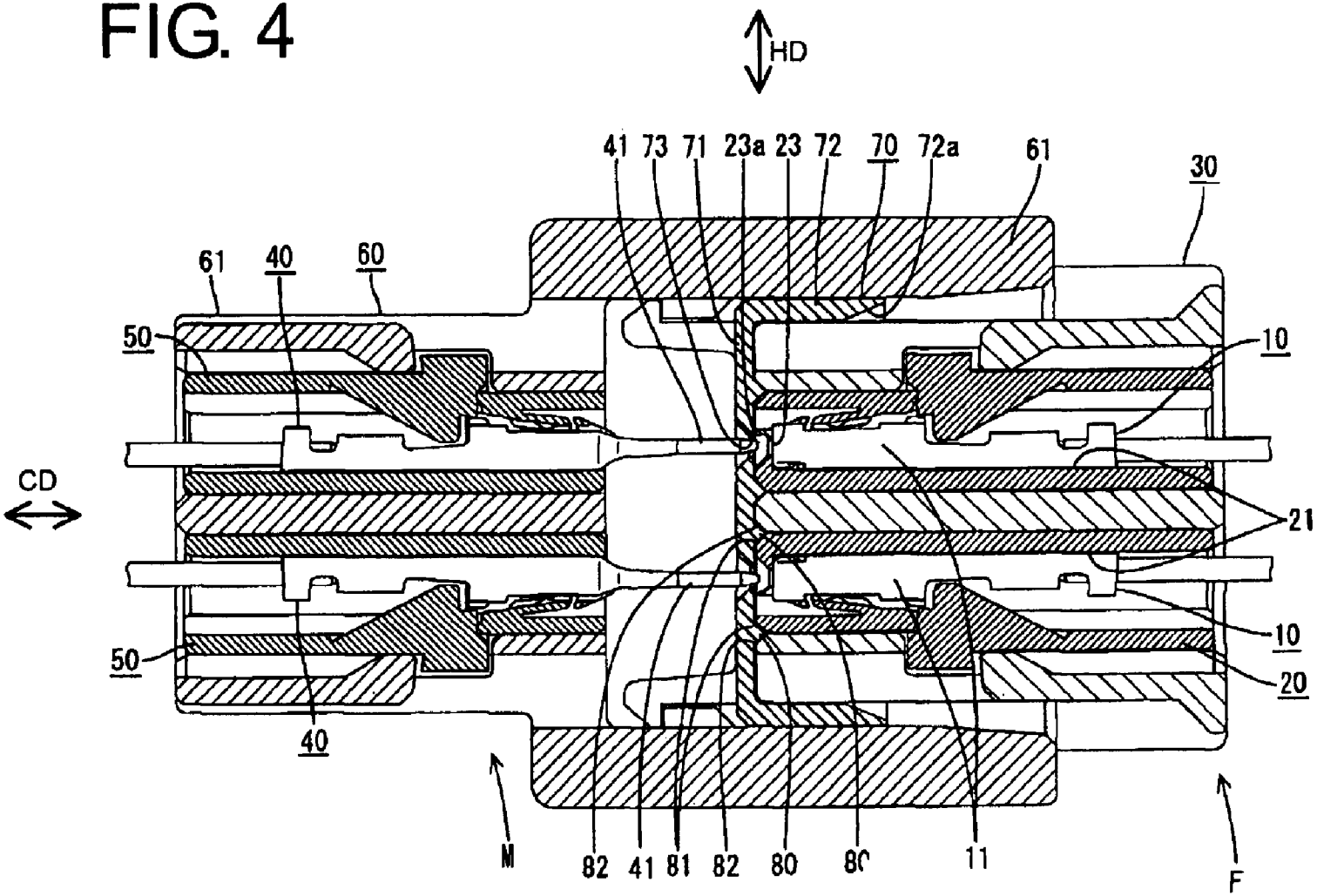
FIG. 4 is a side view in section showing positioning projections engaged with positioning recesses during connection the two connectors.

Subsequently, the two connectors F, M are connected along the connecting direction CD from a state shown in FIG. 3. The female connector F is guided into the receptacle 61 by the guiding slanted surfaces 72*a* of the moving plate 70 into an inner space defined by the side plates 72. The front surface of the female connector F contacts the front surface of the base plate 71 when the female connector F reaches a specified depth, as shown in FIG. 4. At this stage, the tabs 41 are located slightly located in the tab insertion holes 23, but not yet located in the cavities 21. Thus, the tabs 41 are not in contact with the female terminal fittings 10. At this time, the front ends of the female auxiliary housings 20 are held by the positioning projections 80 from above and below along the height direction HD by the engagement of positioning projections 80 with the corresponding positioning recesses 81 and escaping recesses 82. Accordingly, the female auxiliary housings 20 are located at specified positions along the height direction HD and substantially normal to the connecting direction CD with respect to the moving plate 70 even if the female frame 30 and the female auxiliary housings 20 shake relative to each other along the height direction HD due to a molding error or the like. In this way, the tabs 41 and the female terminal fittings 10 accommodated in the female auxiliary housings 20 are positioned along height direction HD and substantially normal to the connecting direction CD. Thus, the tabs 41 smoothly enter the main portions 11 with the help of the guiding slanted surfaces 23*a* and resiliently contact the resilient contact pieces inside as the two connectors F, M are connected further.

Figure 5:
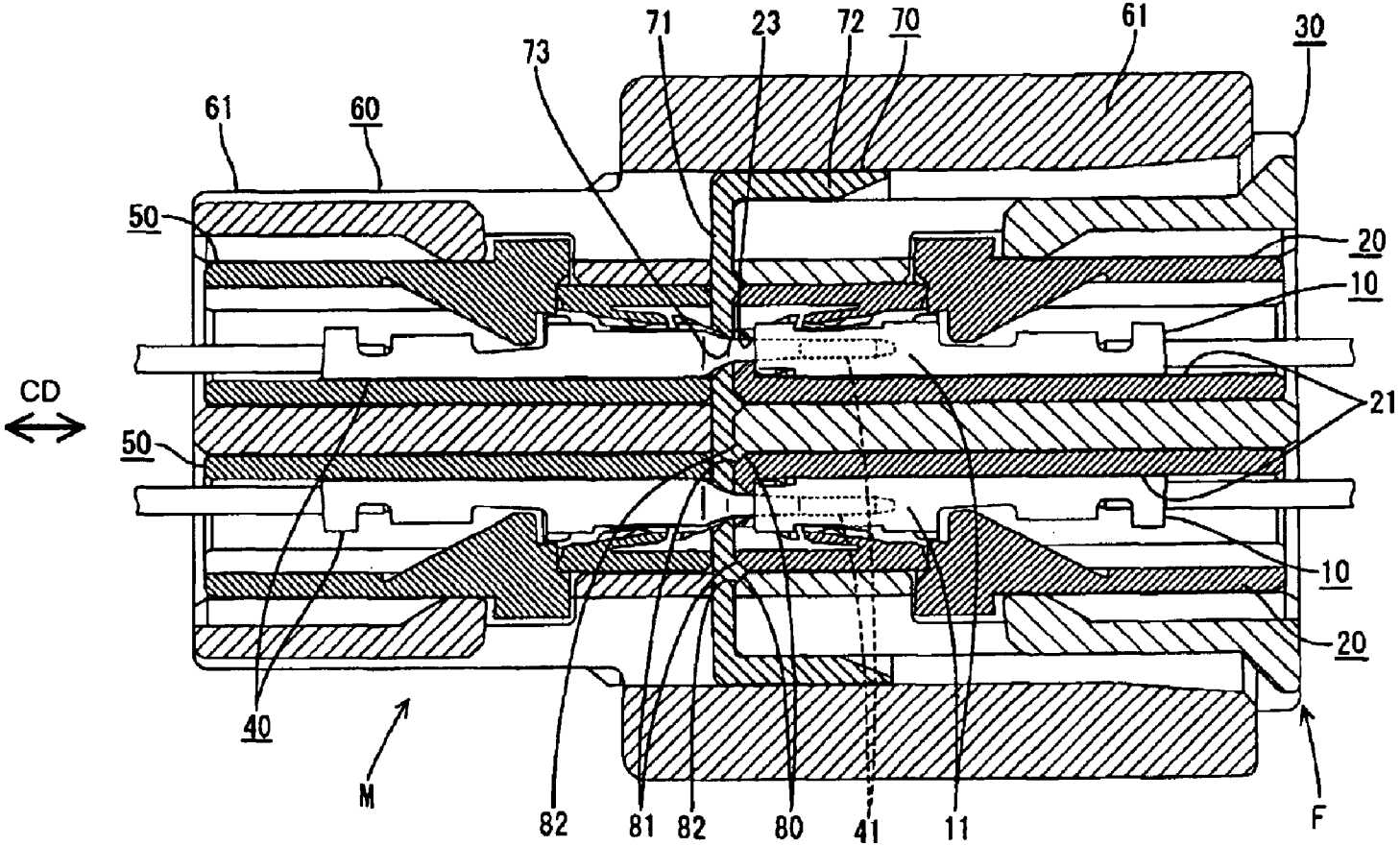
FIG. 5 is a side view in section showing a state where the two connectors are properly connected.

The connecting operation proceeds with the female connector F held in contact with the base plate 71 of the moving plate 70. Thus, the base plate 71 is pushed back by the female connector F, and the moving plate 70 is moved backward together with the female connector F. When the female connector F is connected substantially properly with the male connector M, the tabs 41 are inserted to substantially proper depths in the main portions 11 to establish connections and the lock arm 36 is engaged with the lock portion 67 to hold the two connectors F, M properly connected as shown in FIG. 5. At this time, the moving plate 70 reaches a position where the rear surface of the base plate 71 substantially contacts the back end surface of the receptacle 61 and is held between the male frame 60 and the female connector F, and the base ends of the tabs 41 are located in the positioning holes 73.

As described above, the moving plate 70 and the female auxiliary housings 20 are provided respectively with the positioning projections 80 and the positioning recesses 81, and the female auxiliary housings 20 are positioned with respect to the moving plate 70 by the engagement of the positioning projections 80 with the positioning recesses 81 before the tabs 41 are brought into contact with the female terminal fittings 10. Thus, even if the female auxiliary housings 20 and the female frame 30 shake relative to each other, the tabs 41 can be connected smoothly with the female terminal fittings 10 since both the tabs 41 and the female auxiliary housings 20 are positioned with respect to the moving plate 70.

The positioning projections 80 on the moving plate 70 can be accommodated into the receptacle 61 before the two connectors F, M are connected. Thus, the positioning projections 80 can be protected.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

Although the positioning projections are larger than the positioning recesses and do not conform to them in the foregoing embodiment, outer parts of the positioning projections may be cut off so that the positioning projections have such a shape substantially conforming to that of the positioning recesses. In such a case, the escaping recesses of the female frame may be omitted. Further, the shapes and the numbers of the positioning projections and the positioning recesses can be arbitrarily set.

Although the female auxiliary housings are positioned along height direction by the positioning projections and the positioning recesses in the foregoing embodiment, the female auxiliary housings may be also or alternatively positioned along widthwise direction, for example, by forming one or more positioning recesses at the opposite widthwise edges of the female auxiliary housings and providing the moving plate with one or more corresponding positioning projections engageable with the positioning recesses according to the present invention.

Different from the foregoing embodiment, the moving plate may be provided with the positioning recesses and the female auxiliary housings may be provided with the positioning projections according to the present invention.

A divided connector whose housing is comprised of a male frame and male auxiliary housings is illustrated as the male connector in the foregoing embodiment. However, the invention is also applicable to a case where the male connector is a normal connector comprised of a housing and male terminal fittings to be accommodated inside the housing.

What is claimed is:

1. A connector having a male connector and a female connector connectable with each other substantially along a connecting direction, wherein:

the female connector comprises a female housing for accommodating at least one female terminal fitting;

the male connector comprises at least one male terminal fitting with a tab, a male housing with a receptacle for receiving a female connector and adapted to accommodate the male terminal fittings such that the tab projects into the receptacle, and a moving plate with at least one positioning hole for receiving the tab, the moving plate being movable in the receptacle substantially along the connecting direction; and the moving plate and the female housing comprising positioning means engageable with each other for positioning the moving plate and the female housing laterally with respect to each other.

2. The connector of claim 1, wherein the female connector comprises at least one auxiliary housing for accommodating the female terminal fittings, and a frame for accommodating the auxiliary housings.

3. The connector of claim 2, wherein the moving plate is held between the male housing and the female connector at the time of connecting the two connectors.

4. The connector of claim 2, wherein the positioning means comprise at least one positioning projection on the moving plate and at least one positioning recesses in the female housing for engaging the positioning projections.

5. The connector of claim 4, wherein the positioning recesses are formed by cutting off corners at front edges of the female auxiliary housings over substantially entire widths of the female auxiliary housings.

6. The connector of claim 5, wherein the positioning projection has a converging cross-section.

7. The connector of claim 6, wherein the moving plate is at an initial position before the connectors are connected where the leading ends of the respective tabs are in the positioning holes and slightly project from the front surface of the base plate.

8. The connector of claim 7, wherein the positioning projections project from the front surface of the moving plate by a distance more than a projecting distance of the tabs from the front surface of the base plate when the moving plate is at the initial position.

9. The connector of claim 6, wherein a spacing between the tips of the positioning projections laterally from the positioning holes is substantially equal to the height of the female auxiliary housings.

10. The connector of claim 4, wherein the positioning projection is narrower than the female auxiliary housings.

11. The connector of claim 1, wherein the moving plate comprises a base plate and at least one side plate at an edge of the base plate, wherein a movement of the moving plate substantially along the connecting direction is guided by the sliding contact of the side plates with an inner surface of the receptacle.

* * * * *